US007322613B2

(12) United States Patent
Penuela et al.

(10) Patent No.: US 7,322,613 B2
(45) **Date of Patent: *Jan. 29, 2008**

(54) MULTI-PART FORM HAVING DETACHABLE WRISTBAND, LABELS AND CARDS OR THE LIKE

(75) Inventors: Oswaldo Penuela, Santa Clarita, CA (US); Ronald M. Fullerton, Simi Valley, CA (US)

(73) Assignee: Precision Dynamic, Corporation, San Fernando, CA (US)

( * ) Notice: Subject to any disclaimer, the term of this patent is extended or adjusted under 35 U.S.C. 154(b) by 323 days.

This patent is subject to a terminal disclaimer.

(21) Appl. No.: 10/322,320

(22) Filed: Dec. 17, 2002

(65) Prior Publication Data

US 2004/0113421 A1 Jun. 17, 2004

(51) Int. Cl.
*B42D 15/00* (2006.01)

(52) U.S. Cl. ..... 283/105; 283/81; 40/633

(58) Field of Classification Search ..... 283/81, 283/106; 40/633

See application file for complete search history.

(56) References Cited

U.S. PATENT DOCUMENTS

| | | | | |
|---|---|---|---|---|
| 2,641,074 | A | | 6/1953 | Richmond |
| 3,153,869 | A | | 10/1964 | Twentier |
| 3,197,899 | A | | 8/1965 | Twentier |
| 3,279,107 | A | | 10/1966 | Baumgartner |
| 3,848,112 | A | | 11/1974 | Weichselbaum et al. |
| 3,983,604 | A | | 10/1976 | Phillips |
| 4,078,324 | A | | 3/1978 | Wiebe |
| 4,122,947 | A | | 10/1978 | Falla |
| 4,221,063 | A | | 9/1980 | Charles et al. |
| 4,314,415 | A | | 2/1982 | De Woskin |
| 4,317,964 | A | | 3/1982 | Biggs et al. |
| 4,612,718 | A | | 9/1986 | Golub et al. |
| 4,682,431 | A | | 7/1987 | Kowalchuk |
| 4,914,843 | A | | 4/1990 | DeWoskin |
| 4,916,841 | A | | 4/1990 | Dawson |
| 4,951,971 | A | | 8/1990 | Whited |
| 4,991,337 | A | | 2/1991 | Solon |
| 5,026,084 | A | | 6/1991 | Pasfield |
| 5,048,870 | A | | 9/1991 | Mangini et al. |
| 5,242,326 | A | | 9/1993 | Dexter |
| 5,364,133 | A | | 11/1994 | Hofer et al. |
| 5,615,504 | A | | 4/1997 | Peterson |
| 5,653,472 | A | | 8/1997 | Huddleston et al. |
| 5,933,993 | A | | 8/1999 | Riley |
| 5,979,941 | A | * | 11/1999 | Mosher et al. ..... 283/67 |
| 6,000,160 | A | | 12/1999 | Riley |

(Continued)

*Primary Examiner*—Monica Carter
*Assistant Examiner*—Sara Addisu
(74) *Attorney, Agent, or Firm*—Kelly Lowry & Kelley, LLP

(57) ABSTRACT

A multi-part form includes a printable face ply that is die cut to create a detachable wristband, labels and/or cards and is particularly useful in a hospital-patient environment. The face ply includes a first major surface and a second major surface. A pressure sensitive adhesive is located on at least a portion of one of the major surfaces. The multi-part form includes a first portion, second portion and intermediate portion. The multi-part form further includes a liner ply with first and second major surfaces where a release coating is located on at least a portion of one of major surfaces of the liner ply. The liner ply is adhered to the pressure sensitive adhesive on the face ply.

41 Claims, 6 Drawing Sheets

U.S. PATENT DOCUMENTS 6,067,739 A 5/2000 Riley
6,179,337 B1 * 1/2001 Zumberge ..... 283/81
6,212,808 B1 4/2001 Rubel
6,438,881 B1 8/2002 Riley
6,510,634 B1 1/2003 Riley
6,641,048 B1 * 11/2003 Schintz et al. ..... 235/487
6,656,555 B1 * 12/2003 McKillip ..... 428/40.1
6,971,200 B2 12/2005 Valenti
2001/0015553 A1 * 8/2001 Herreros Rodriguez et al. ..... 283/74
2004/0164544 A1 * 8/2004 Thall et al. ..... 283/62

* cited by examiner

MULTI-PART FORM HAVING DETACHABLE WRISTBAND, LABELS AND CARDS OR THE LIKE

BACKGROUND OF THE INVENTION

This invention relates to a printable form. More particularly, the present invention relates to a multi-part form having a detachable wristband accompanied by a plurality of detachable labels, cards, tags or the like, which may be printed with information in a single pass through a printer.

The use of identification bracelets in hospital settings to identify individual patients is a common practice. The identification bracelet, which may include the patient's name and room number, is generally secured around the wrist of the patient during his or her stay at the hospital. While this has been useful to identify patients, some hospitals and medical clinics have experienced problems correlating patients with information relating to their lab results, specimens, prescriptions, billing, newborn babies, etc. Clerical errors in the handling of such routine matters can result in the dispensing of the wrong medicine or a newborn baby going home with the wrong mother.

Attempts have been made to improve the correlation of patient information to lab results, specimens, prescriptions, etc. For example, Falla, U.S. Pat. No. 4,122,947, teaches a pre-packaged patient identification kit which includes a wristband, a specimen container, and a label for attachment to a patient's record, all of which have been provided with identical patient information. However, more than one specimen container or label may be required and adding pre-identified specimen containers to the identification kit can increase the cost of such a kit. In another example, Huddleston et al., U.S. Pat. No. 5,653,472, teaches a form having a detachable wristband and labels. While methods such as those described above may provide means of identifying a patient for various purposes, such methods either lack more than two different types of identification elements and/or limit the end users' flexibility in using multi-part printable forms to create various patient indicia of one or more materials.

Accordingly, there is a need for a low-cost identification media that can provide multiple identification elements containing identical and/or overlapping information and which is capable of being produced in any desired quantity and/or as the needs arises. The present invention fulfills these needs and provides other related advantages.

SUMMARY OF THE INVENTION

The present invention resides in a printable multi-part form having labels, assorted tags and a wristband that can be separated via perforations in the form. A multi-part form embodying the invention comprises, generally, a printable face ply having at least three distinct portions, and a liner ply which underlies the printable face ply. A pressure sensitive adhesive is provided on at least a portion of a major surface of the face ply and, similarly, a release coating is provided on at least a portion of a major surface of the liner ply, whereby the liner ply is adhered to the pressure sensitive adhesive of the face ply.

In one illustrated embodiment, the printable face ply includes a first major surface, a second major surface, and a pressure sensitive adhesive on at least a portion of one of the first and second major surfaces. A first portion of the face ply forms a detachable wristband having first and second ends and first and second sides. A second portion of the face ply forms a series of detachable labels, and an intermediate portion forming one or more removable cards is disposed between the first and second portions of the face ply. The face ply may be comprised of different types of materials, such as a polymer and paper. Further, the first surface of the face ply is intended to include printed indicia thereon.

A liner ply underlies the face ply and includes first and second major surfaces. A release coating on at least a portion of one of the first and second major surfaces of the liner ply is provided, whereby the liner ply is adhered to the pressure sensitive adhesive of the face ply.

The first, second and intermediate portions of the face ply are separable from one another. In this regard, the liner ply comprises first, second and intermediate portions, the first portion of the liner ply adhering to the first portion of the face ply, the second portion of the liner ply adhering to the second portion of the face ply, and wherein the intermediate portion of the liner ply adheres to the intermediate portion of the face ply. The liner ply is typically coextensive with the face ply.

The first potion of the face ply is die cut to form the detachable wristband. Similarly, the second portion of the face ply is die cut to form the series of detachable labels, and the intermediate portion of the face ply is also die cut to form one or more removable cards.

The second surface of the first portion of the face ply includes the pressure sensitive adhesive around the periphery of the wristband and on at least one end and of the wristband. The second surface of the first portion of the face ply includes a pressure sensitive adhesive in an area containing the series of labels. At least a portion of the pressure sensitive adhesive adheres the intermediate portion of the face ply directly to the liner ply in one embodiment.

The multi-part form may also be fashioned to comprise a continuous web of forms which may or may not include a plurality of tractor feed pinholes.

In yet another embodiment of the invention, an electromagnetic chip for carrying information is imbedded into the face ply. The electromagnetic chip may take the form of a computer chip or radio frequency identification (RFID) chip to afford a higher degree of identification capability to the multi-part form. Of course, such a chip may be embedded within the labels or other elements of the multi-part form as well.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
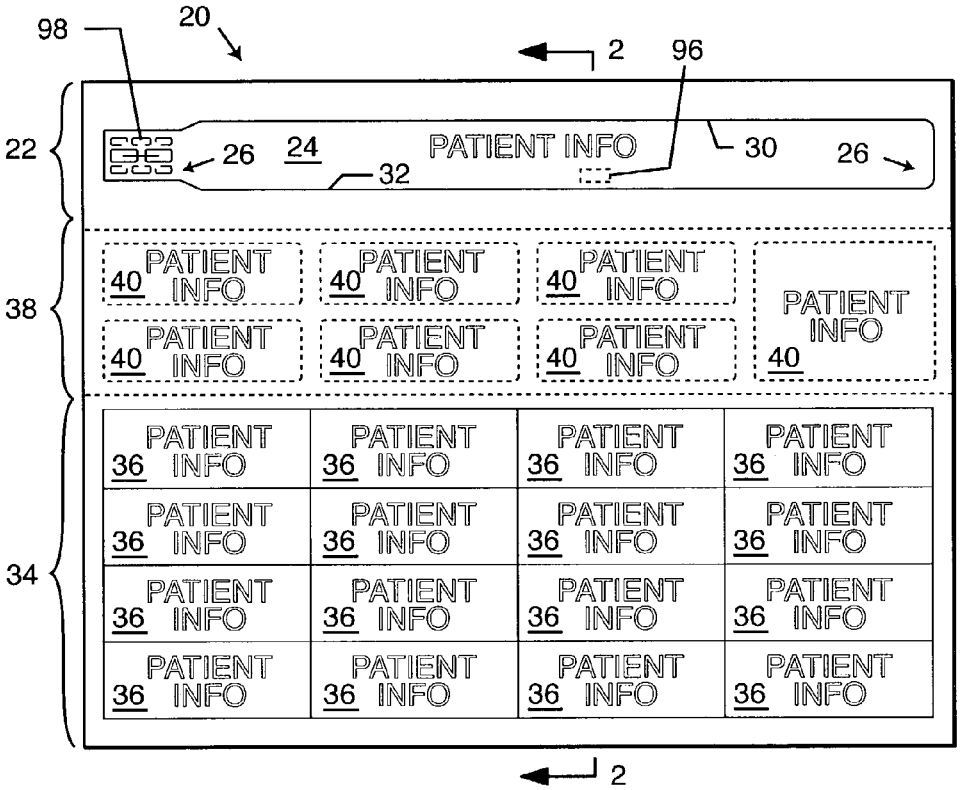
FIG. 1 is a top plan view of a multi-part form embodying the invention.
Figure 2:
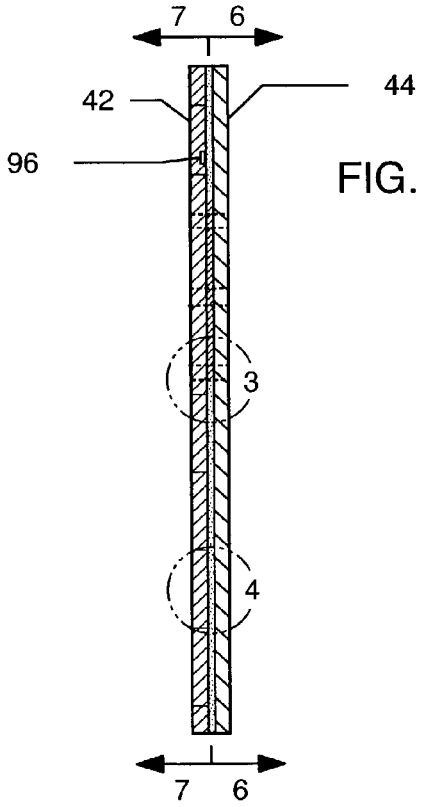
FIG. 2 is a cross-sectional view of the multi-part form taken along line 2-2 in FIG. 1.

As illustrated in FIGS. 1 and 2, a multi-part form 20 is shown which includes a first portion 22 which is die cut to form a detachable wristband 24 having a first end 36, a second end 28, a first side 30, and a second side 32. The form 20 further includes a second portion 34 which is die cut to form a series of detachable labels 36, and an intermediate portion 38 disposed between the first and second portions 22, 34. The intermediate portion 38 is die cut to form one or more removable cards 40, such as a punch-out card that separates from the form 20 along die-cut perforations. The card 40 can be used as a business card, an identification card, a tag, or the like. If the card 40 is used as a tag, a perforation in the form of a circle can be die-cut in the card 40 in order to form a hole that can be used, for example, to attach the tag to a patient's body part. Each portion 22, 34, 38 is separated from the other portions by perforations in the form 20, allowing each portion 22, 34, 38 to be detached from the other portions. The labels 36 and cards 40 may be rectangular in shape but could also be circular, square, triangular, or any polygonal shape.

The wristband 24, the labels 36, and the cards 40 may be printed with indicia which is identical in each portion 22, 34, 38 (i.e., indicia printed on the first portion 22 corresponds to the indicia printed on the second portion 34 and/or the indicia printed on the intermediate portion 38). This identical information may include 'nonvariable' information (i.e., information which does not change from label-to-label or patient-to-patient) such as the name of the hospital, hospital department (e.g., maternity, oncology, etc.). The identical information may also include 'variable' information (i.e., information which is unique to an individual and which changes from label to label) such as the patient's name, blood-type, patient number assigned by the hospital (in numeric or bar code form), etc. Alternatively, the wristband 24, the labels 36, and the cards 40 may be printed with indicia which differs from portion-to-portion. For example, the first, second and intermediate portions 22, 34, 38 may each be printed with a different set or subset of patient information but with at least one common piece of identifying patient information. In this example, the wristband 24 may contain the patient's name, blood-type and patient identification number in bar code form) while the detachable labels 36 or cards 40 may only contain the bar code corresponding to the patient identification number. Hospital personnel would be able to access all of the patient's information by scanning the bar code with a bar code reader attached to a stand-alone computer in which patient records are stored, or a workstation, wireless device, cellular phone or other similar device in communication with the hospital's mainframe in which the patient's information is stored. In another alternative, the wristband 24, the labels 36, and the cards 40 may be printed with completely different patient identification information (e.g., the wristband 24 includes the patient's name only, the labels 36 include only the patient's patient number in barcode form, and the cards 40 include only the patient's patient number in numeric form). The patient identification information printed on the wristband 24, the labels 36, and the cards 40 may be adjusted to meet the individual needs of a particular patient.

Figure 3:
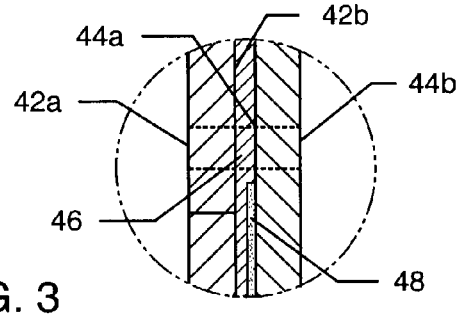
FIG. 3 is an enlarged fragmented view of the area indicated by the line 3 in FIG. 2.
Figure 4:
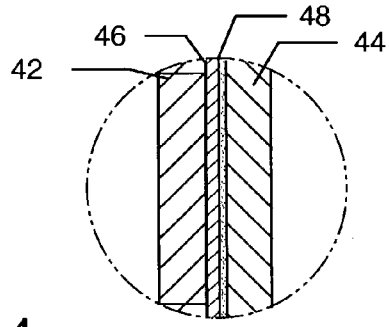
FIG. 4 is an enlarged fragmented view of the area indicated by the line 4 in FIG. 2.

As illustrated in FIGS. 2, 3, and 4, the form 20 further comprises a printable face ply 42 having a first surface 42*a* and a second surface 42*b* and a liner ply 44 having a first surface 44*a* and a second surface 44*b*. The material comprising the face ply 42 may vary in each portion 22, 34, 38 or the entire face ply 42 may be made of the same material. For example, the face ply 42 of the first portion 22 may be comprised of a different material than the face ply 42 in the intermediate portion 38 while the face ply 42 of the second portion 34 may be the same material as the face ply 42 of the intermediate portion 38. Various materials may be used, including but not limited to paper, paper-like materials, polyester, polymer, etc. It is desirable to use a durable material for the wristband 24 such that the wristband 24 is strong enough to be worn for several hours, if not days.

Figure 6:
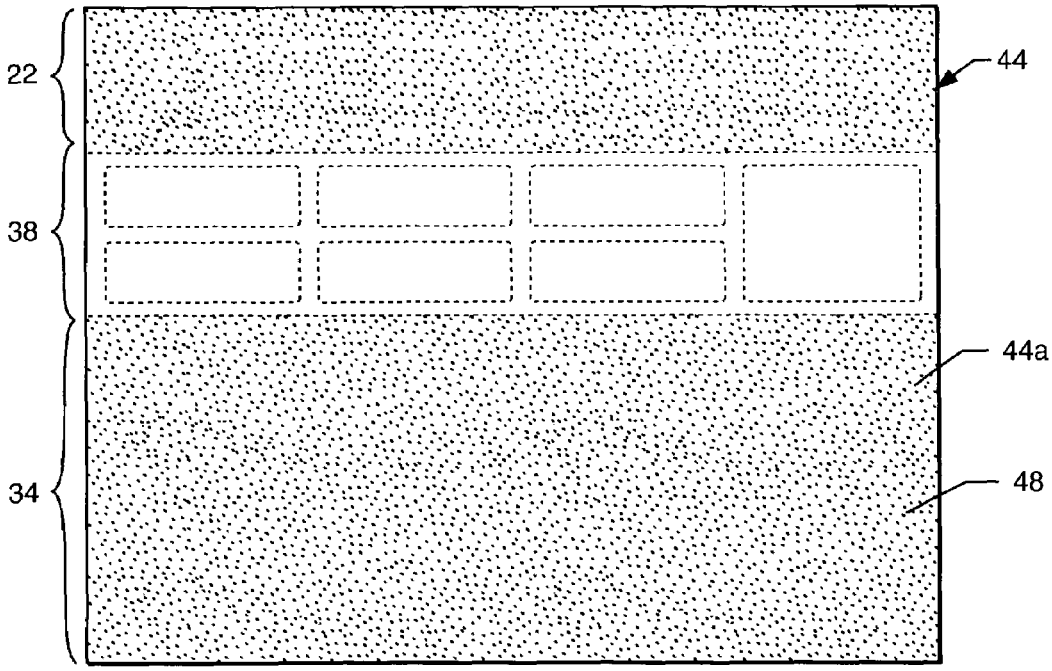
FIG. 6 is a sectional view taken along the line 6-6 of FIG. 2, illustrating a release coating applied to a liner ply.

The face ply 42 is adhered to the liner ply 44 by a pressure sensitive adhesive 46 included on a portion of the second surface 42*b* of the face ply 42. The liner ply 44 generally includes a release coating 48 on the first surface 44*a* which faces the second surface 42*b* of the face play 42. The release coating 48 allows the face ply 42 to be readily peeled away from the liner ply 44. The release coating 48 may be in the form of a silicone coating. However, as seen in FIG. 6, the section of the liner ply 44 corresponding to the intermediate portion 38 is not covered with the release coating 48. The die-cut perforations forming the cards 40 in the intermediate portion 38 extend through both the face ply 42 and the liner ply 44.

The form 20 may be configured as a single sheet that may be printed in a single pass through a printer to provide the elements of the form 20 with correlating printed indicia, including but not limited to bar codes. The face ply 42 may be printed using a number of different automated printing devices including impact printers, ion deposition printers, ink jet printers, laser printers, direct thermal printers, and thermal transfer printers. If direct thermal printing is used, an imaging coating must be provided on the face ply 42 of the form 20. In the alternative, the form 20 may be printed as one sheet of a plurality of co-planar sheets being printed concurrently.

Figure 5:
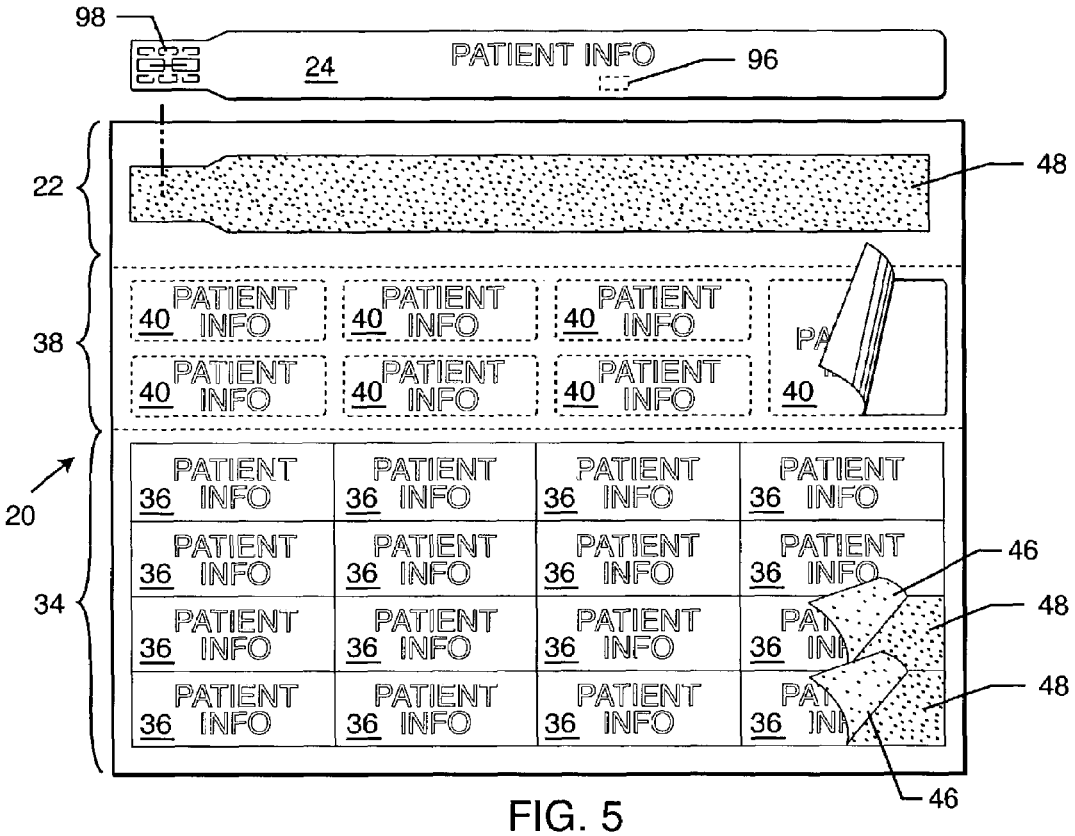
FIG. 5 is a top plan view of the form similar to FIG. 1, showing the wristband detached from the multi-part form and exposing the liner ply, labels partially detached from the multi-part form and exposing the liner ply, and cards partially detached from the multi-part form.

The wristband 24 is detachable from the form 20 and FIG. 5 also shows two of the labels 36 partially peeled away from a section of the liner ply 44. One of the cards 40 is also shown partially detached from the form 20. A detached card 40 includes both the face ply 42 and the liner ply 44. In this embodiment, there are four rows and four columns of the detachable labels 36. The sizes of the cards 40 in the intermediate portion 38 may vary. For example, in this embodiment of the invention, there are six small rectangular cards and one large rectangular card.

FIGS. 2-6 show that portions of the first surface 44*a* of the liner ply 44 include release coating 48. For example, the release coating 48 is included in first portion 22 and in the second portion 34 to allow release of the wristband 24 and detachable labels 36. The release coating 48 may be full coated or pattern coated, as seen in FIG. 6, if there are areas, such as the cards 40 in the intermediate portion 38, where the release coating 48 may not be necessary.

Figure 7:
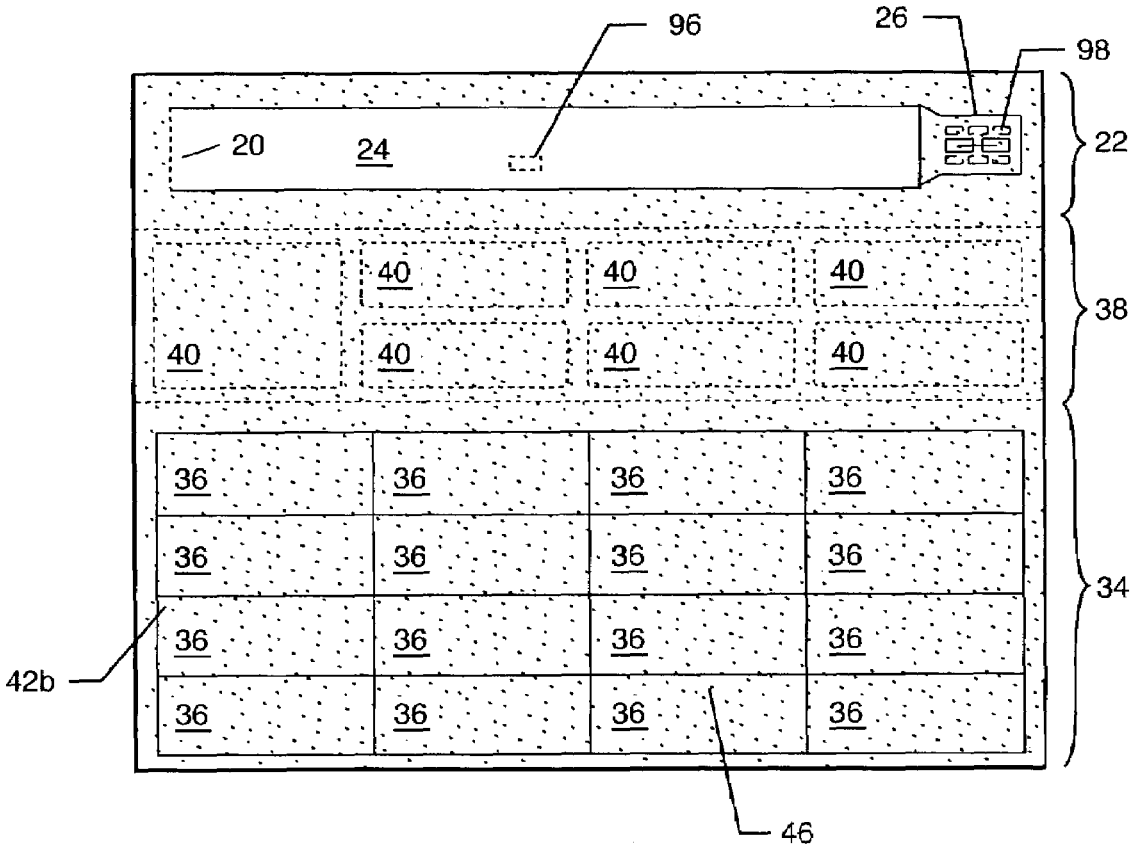
FIG. 7 is a bottom plan view, taken along line 606 of FIG. 2, of a face ply of the multi-part form shown in FIGS. 1 and 5.
Figure 8:
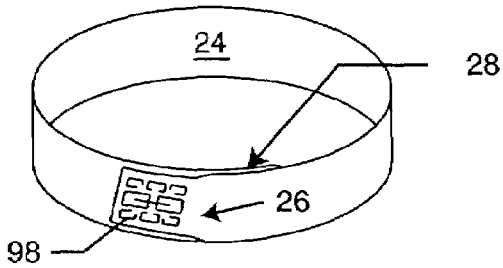
FIG. 8 is a perspective view illustrating how to secure the wristband of FIG. 5.

As illustrated in FIGS. 2 and 7, portions of the second surface 42*b* of the face ply 42 include pressure sensitive adhesive 46. As shown in this embodiment, the pressure sensitive adhesive 46 is included in first portion 22 around and outside the periphery of the wristband 24 along sides 30, 32, and on the first end 26 of the wristband 24. In the second portion 34, the pressure sensitive adhesive 46 is included in the area containing the detachable labels 36. The pressure sensitive adhesive 46 may be pattern-coated or full coated, as shown in FIG. 7 where, in the intermediate portion 38, the pressure sensitive adhesive 46 is included in the area containing the cards 40.

FIG. 5 illustrates that, after the wristband 24 is peeled away from the liner ply 44, the wristband 24 is wrapped around a user's wrist (not shown for clarity) where the first end 26 is wrapped around the wristband 24 in an overlapping position so that the first end 26 overlaps the second end 28. The first end 26 is secured to the main body of the wristband 24 by the pressure sensitive adhesive 46 on the end 26 of the wristband 24. A die cut tamper-resistant pattern 98 is located on the first end 26 as a security provision which helps prevent re-use of the wristband 24. When a user attempts to remove the wristband 24, the end 26 will tear along the die-cuts of the pattern 28, rendering the wristband 24 unfit for re-use, as it will be apparent to anyone checking the wristband 24 that the wristband 24 has been tampered with.

Figure 9:
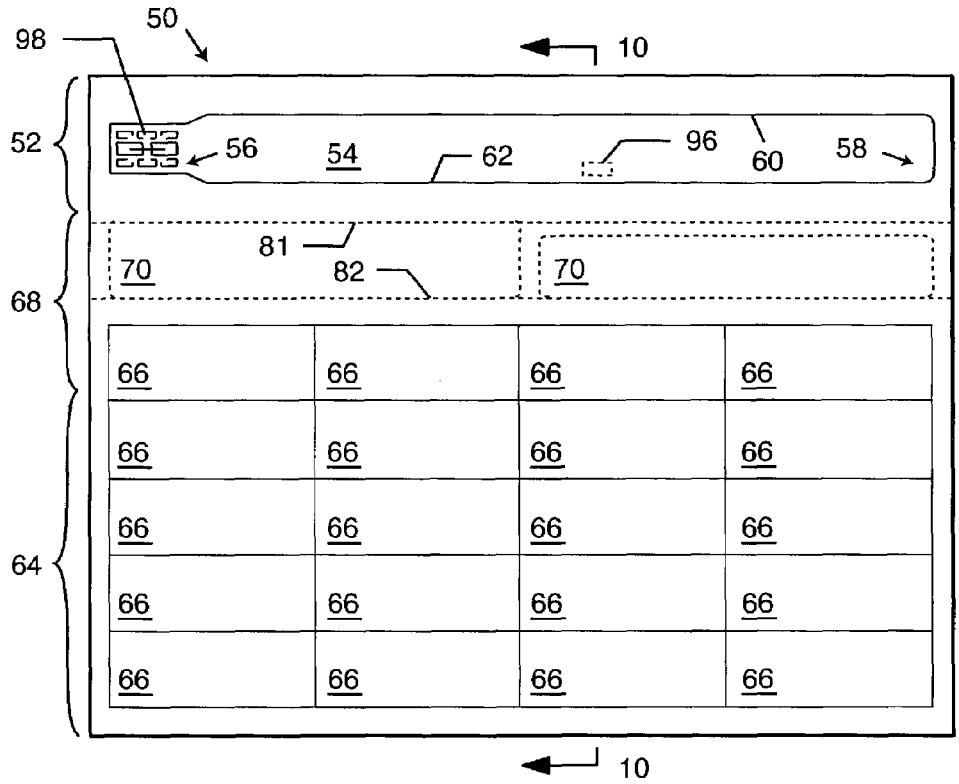
FIG. 9 is a top plan view of an alternative embodiment of the multi-part form of the present invention.

As illustrated in FIG. 9, an alternative embodiment of form 50 is shown which includes a first portion 52 which is die cut to form a detachable wristband 54 having a first end 56, a second end 58, a first side 60, and a second side 62. The form 50 further includes a second portion 64 which is die cut to form a series of detachable labels 66, and an intermediate portion 68 disposed between the first and second portions 52, 64. The intermediate portion 68 is die cut to form one or more removable cards 70. The card 70 can be used as a business card, an identification card, a tag, or the like. If the card 70 is used as a tag, a perforation in the form of a circle can be die-cut in the card 70 in order to form a hole that can be used, for example, to attach the tag to a patient's body part. Each portion 52, 64, 68 is separated from the other portions by perforations in the form 50, allowing each portion 52, 54, 68 to be detached from the other portions.

The wristband 54, the labels 66, and the cards 70 may be printed with indicia which is identical in each portion 52, 64, 68 (i.e., indicia printed on the first portion 52 corresponds to the indicia printed on the second portion 64 and/or the indicia printed on the intermediate portion 68). As outlined above, this identical information may include 'variable' and 'nonvariable' information. Likewise, the indicia printed on the form 50 may differ from portion-to-portion, as outlined above.

Figure 10:
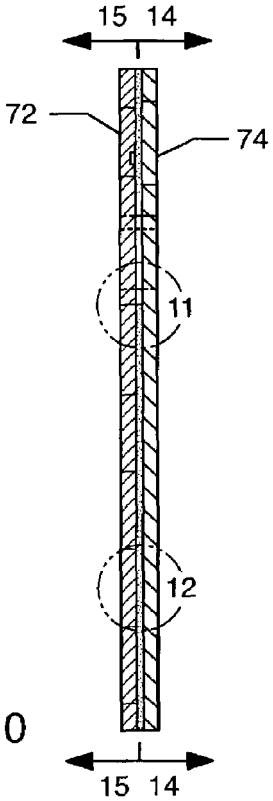
FIG. 10 is a cross-sectional view of the multi-part form taken along line 10-10 of FIG. 9.
Figure 11:
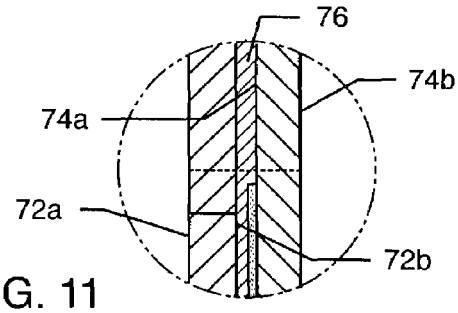
FIG. 11 is an enlarged fragmented view of the area indicated by the line 11 in FIG. 10.
Figure 12:
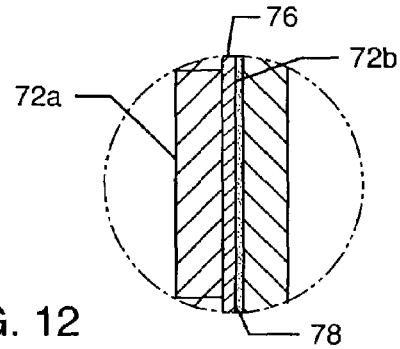
FIG. 12 is an enlarged fragmented view of the area indicated by the line 12 in FIG. 10.

As illustrated in FIGS. 10-12, the form 50 further comprises a printable face ply 72 having a first surface 72*a* and a second surface 72*b* and a liner ply 74 having a first surface 74*a* and a second surface 74*b*. The material comprising the face ply 72 may vary in each portion 52, 64, 68 or the entire face ply 72 may be made of the same material. For example, the face ply 72 of the first portion 52 may be comprised of a different material than the face ply 72 in the intermediate portion 68 while the face ply 72 of the second portion 64 may be the same material as the face ply 72 of the intermediate portion 68. Various materials may be used, including but not limited to paper, paper-like materials, polyester, polymer, etc. It is desirable to use a durable material for the wristband 54 such that the wristband 54 is strong enough to be worn for several hours, if not days.

Figure 14:
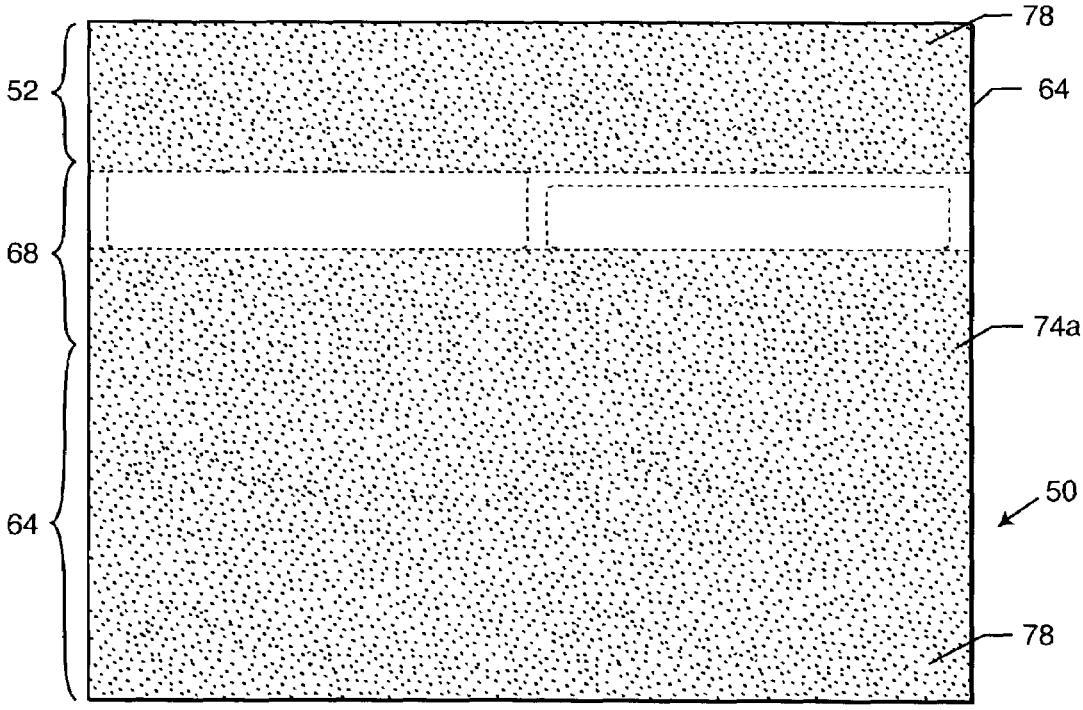
FIG. 14 is a sectional view taken along the line 14-14 of FIG. 10, illustrating a release coating applied to a liner ply.

The face ply 72 is adhered to the liner ply 74 by a pressure sensitive adhesive 76 included on a portion of the second surface 72*b* of the face ply 72. The liner ply 74 generally includes a release coating 78 on the first surface 74*a* which faces the second surface 72*b* of the face play 72. The release coating 78 allows the face ply 72 to be readily peeled away from the liner ply 74. The release coating 78 may be in the form of a silicone coating. However, as seen in FIG. 14, the section of the liner ply 74 corresponding to the intermediate portion 68 is not covered with the release coating 78. The die-cut perforations forming the cards 70 the intermediate portion 68 extend through both the face ply 72 and the liner ply 74.

The form 50 may be configured as a single sheet that may be printed in a single pass through a printer to provide the elements of the form 50 with correlating printed indicia, including but not limited to bar codes. The face ply 72 may be printed using a number of different automated printing devices including impact printers, ion deposition printers, ink jet printers, laser printers, direct thermal printers, and thermal transfer printers. If direct thermal printing is used, an imaging coating must be provided on the face ply 72 of the form 50. In the alternative, the form 50 may be printed as one sheet of a plurality of co-planar sheets being printed concurrently.

Figure 13:
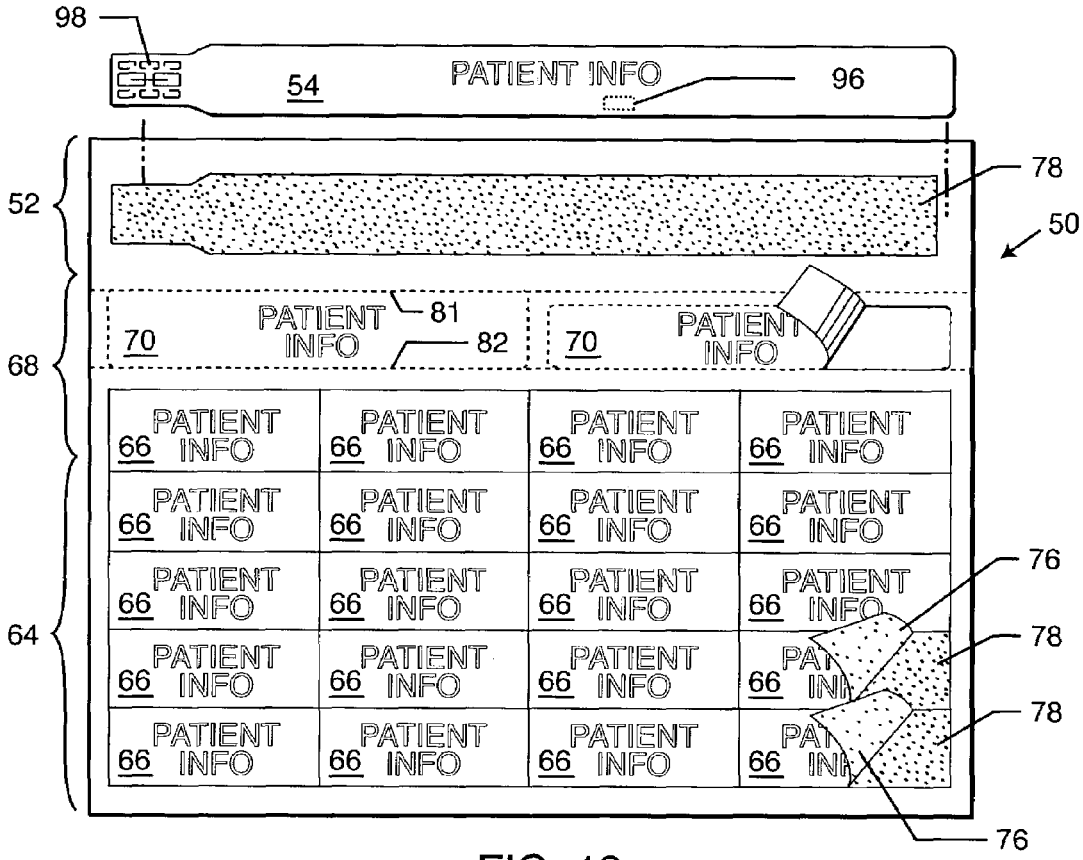
FIG. 13 is a top plan view of the multi-part form of FIG. 9, showing the wristband detached from the multi-part form and exposing the liner ply, labels partially detached from the multi-part form and exposing the liner ply, and cards partially detached from the multi-part form.

FIG. 13 shows the wristband 54 is detachable from the form 50 and two of the labels 66 are also shown partially peeled away from a section of the liner ply 74. One of the cards 70 is also shown partially detached from the form 50. A detached card 70 includes both the face ply 72 and the liner ply 74. In this embodiment, there are five rows and four columns of the detachable labels 66. The sizes of the cards 70 in the intermediate portion 68 may vary. For example, in this embodiment, of the invention, there are two rectangular cards where the top and bottom sides 81, 82 of one of the cards 40 are defined by the die-cut perforations between the intermediate portion 68 and the first and second portions 52, 64.

As illustrated in FIGS. 10-13, portions of the first surface 74*a* of the liner ply 74 include release coating 78. For example, the release coating 78 is included in first portion 52 and in the second portion 34 to allow release of the wristband 54 and detachable labels 66. The release coating 78 may be full coated, or pattern coated, as seen in FIG. 14, if there are areas, such as the cards 70 in the intermediate portion 68, where the release coating 78 may not be necessary.

Figure 15:
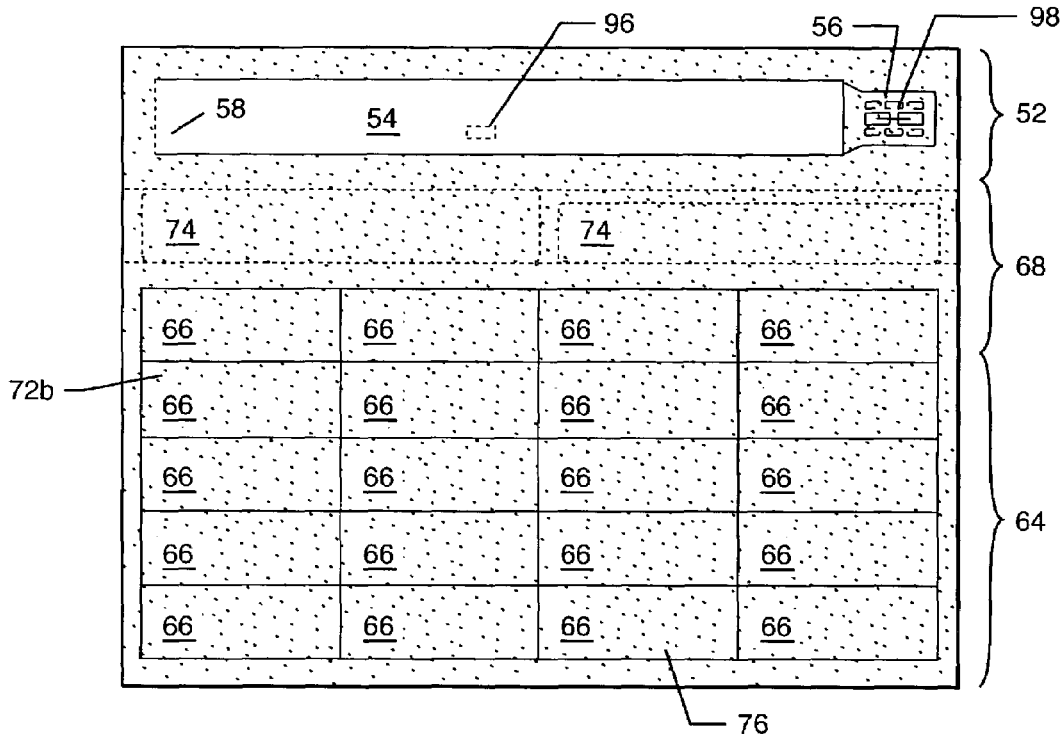
FIG. 15 is a bottom plan view, taken along line 15-15 of FIG. 10, of a face ply of the multi-part form shown in FIGS. 9 and 13.

FIGS. 10-13 and 15 illustrate that portions of the second surface 72*b* of the face ply 72 include pressure sensitive adhesive 76. As shown in this embodiment, the pressure sensitive adhesive 76 is included in first portion 52 around and outside the periphery of the wristband 54 along sides 60, 62, and on the first end 66 of the wristband 54. In the second portion 64, the pressure sensitive adhesive 76 is included in the area containing the detachable labels 66. The pressure sensitive adhesive 76 may be pattern-coated as seen in FIG. 15 where, in the intermediate portion 68, the pressure sensitive adhesive 76 is included in the area containing the cards 70, or full coated.

In the alternative, the arrangement of the wristband 24, 54, cards 40, 70 and labels 36, 66 on the form 11, 50 may be varied in size, shape, number, color, etc. For example, the form may include additional wristbands, a greater number of labels, tags and/or cards, or a fewer number of labels, tags and/or cards.

Figure 16:
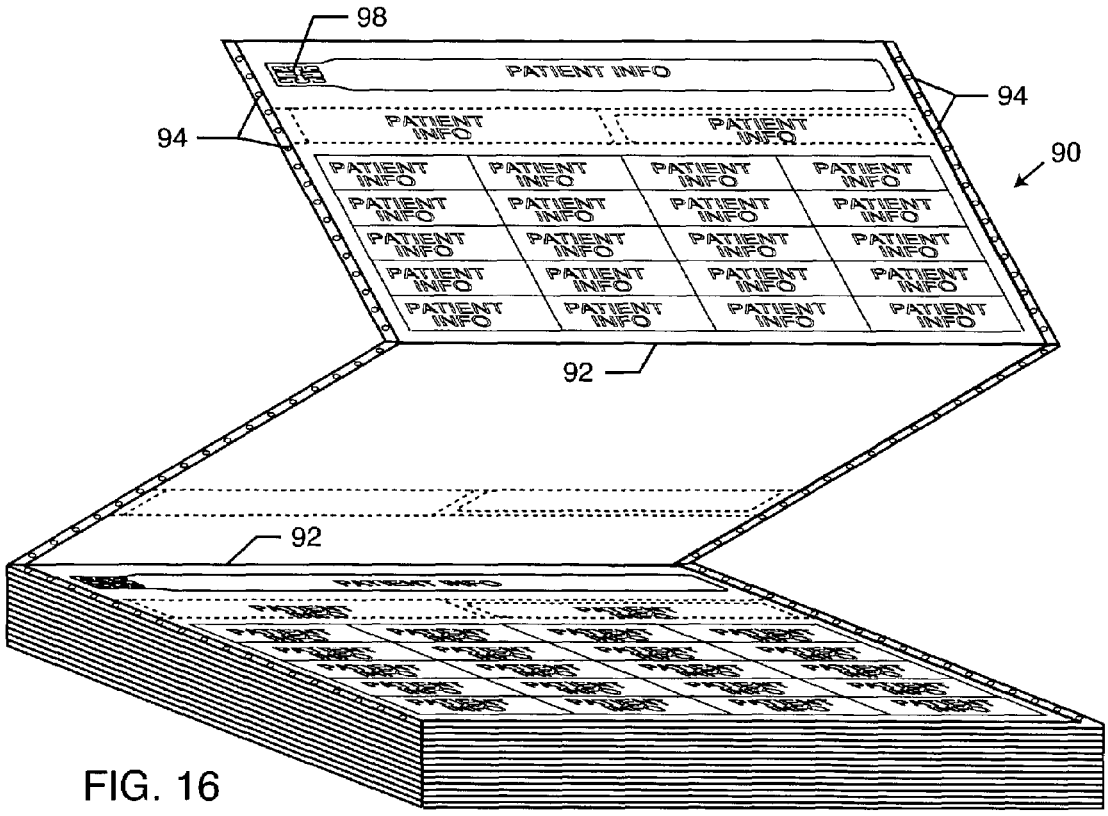
FIG. 16 is a perspective view of a stack of continuous forms constructed in accordance with the present invention.

As illustrated in FIG. 16, the present invention may be produced as a continuous series of forms 90 detachably connected end-to-end along die-cut perforations (i.e., lines of weakness) 92 located between the forms at the top and/or bottom of each form. The series of forms 90 are stackable in a zig-zag fashion. This continuous series of forms may be fed through a printer in a single pass to add the indicia simultaneously on the wristband 24, 54 as well as the cards 40, 70 and labels 36, 66. In the alternative, the continuous series of forms 90 may be produced with standard vertical perforations (i.e., tractor feed pin holes) 94 on both sides of each form for use with printers that include pin-feed protrusions.

An electromagnetic chip for carrying information 96, in the form of a computer chip or RFID inlet 96 may be imbedded in the wristband 24, 54, labels 36, 66 and other elements 40, 70 to afford a higher degree of identification capability. A reader (not shown) is used to 'read' the chip. Any commercially available chip may be used, including, for example, Hitachi Corporation's meu-chip which is wireless accessible at 2.45 GHz, can store up to 128 bits of data, and at 0.4 mm square is thin enough to be embedded in paper.

In use, a patient will check into a hospital and provide the hospital with standard information, such as the patient's name, health insurance provider, blood type, age, etc. This information will be used to create a hospital chart for the patient as well as a computerized record of the information. The hospital may then use a multi-part form to create a wristband 24, labels 36 and cards 40 that will be attached to and/or accompany the patient and/or the patient's chart or specimens. The wristband 24, the labels 36, and the cards 40 may be printed with the name of the hospital and the hospital department the patient is checked into. For example, a woman giving birth will usually be checked into a hospital's maternity ward. The patient will then be provided a wristband 24 that may include her name, blood type, and patient identification number, in addition to the information described above. A label 36 may be adhered to the hospital chart prepared by the hospital staff. The label may include the patient's identification number in numeric or barcode form so that a doctor or nurse at the patient's bedside or nurse's station can scan the barcode and pull up the patient's records from the hospital's computer database. While waiting to give birth, blood samples may be taken from the patient and analyzed. Labels 36 with the patient's identification number (in numeric and/or barcode form) may be attached to the samples so that lab technicians will be able to identify which patient the sample was taken from and/or pull up the patient's records so that additional entries can be made by the lab technician with respect to the test results on the sample. Once the patient has given birth, a label 36 or card 40 with the mother's information may be attached to a wristband provided to the infant and/or attached to the infant's chart. The infant may also be provided with its own identification number. The mother's and infant's information may then be coordinated so that babies are not accidentally switched by the hospital and the right infant goes home with the right mother.

While the form 20, 50, 90 of the present invention has been described in a hospital or medical setting, applications are possible in other settings. For example, the present invention is also applicable in business settings, recreational settings, or security settings where identification security is combined with the need to match two or more elements such as matching an airline passenger with his/her luggage where the baggage identification label issued to the passenger is compared to the baggage identification label attached to the luggage.

The above-described embodiments of the present invention are illustrative only and not limiting. It will thus be apparent to those skilled in the art that various changes and modifications may be made without departing from this invention in its broader aspects. Therefore, the appended claims encompass all such changes and modifications as falling within the true spirit and scope of this invention.

What is claimed is:

1. A multi-part form, comprising:

a single sheet, printable face ply including a first major surface, a second major surface, a pressure sensitive adhesive on at least a portion of one of the first and second major surfaces, a first portion forming a detachable wristband having first and second ends and first and second sides, a second portion forming a series of detachable labels, and an intermediate portion forming one or more removable cards disposed between the first and second portions;

a liner ply underlying the face ply and including first and second major surfaces; and a release coating on at least a portion of one of the first and second major surfaces of the liner ply, whereby the liner ply and release coating is adhered to the pressure sensitive adhesive of the face ply, and the release coating does not underlie the removable cards.

2. The multi-part form of claim 1, wherein the first, second and intermediate portions of the face ply are separable from one another.

3. The multi-part form of claim 2, wherein the liner ply comprises first, second and intermediate portions, the first portion of the liner ply and release coating adheres to the first portion of the face ply, the second portion of the liner ply and release coating adheres to the second portion of the face ply, and wherein the intermediate portion of the liner ply adheres to the intermediate portion of the face ply.

4. The multi-part form of claim 2, wherein the first portion of the face ply comprises a polymer and the second portion of the face ply comprises paper.

5. The multi-part form of claim 1, further comprising an electromagnetic chip for carrying identifying information, embedded in the face ply.

6. The multi-part form of claim 1, wherein the first portion of the face ply is die cut to form the detachable wristband, the second portion of the face ply is die cut to form the series of detachable labels, and the intermediate portion of the face ply and the underlying liner ply is die cut to form the removable cards.

7. The multi-part form of claim 1, wherein the liner ply is coextensive with the face ply.

8. The multi-part form of claim 7, wherein the first surface of the face ply includes printed indicia thereon.

9. The multi-part form of claim 8, wherein the second surface of the first portion of the face ply includes the pressure sensitive adhesive around the periphery of the wristband and on at least one end of the wristband, and wherein the second surface of the second portion of the face ply includes a pressure sensitive adhesive in an area containing the series of labels.

10. The multi-part form of claim 7, wherein at least a portion of the pressure sensitive adhesive adheres the intermediate portion of the face ply directly to the liner ply.

11. The multi-part form of claim 1, wherein the form comprises a continuous web of forms.

12. The multi-part form of claim 11, wherein the continuous web of forms includes a plurality of tractor feed pin holes.

13. A multi-part form, comprising:

a single sheet, printable face ply including a first major surface, a second major surface, a pressure sensitive adhesive on at least a portion of one of the first and second major surfaces, a first portion, a second portion and an intermediate portion disposed between the first and second portions, wherein any one of the portions forms a detachable wristband having first and second ends and first and second sides, any one of two remaining portions forms a series of detachable labels, and the remaining portion forms one or more removable cards, and wherein second and intermediate portions of the face ply are separable from one another; and a liner ply coextensive with the face ply and including first and second major surfaces, and a release coating on at least a portion of one of the first and second major surfaces of the liner ply, the release coating does not underlie the removable cards, wherein the liner ply comprises first, second and intermediate portions, the first portion of the liner ply and release coating adhering to the first portion of the face ply, the second portion of the liner ply and release coating adhering to the second portion of the face ply, and wherein the intermediate portion of the liner ply adheres to the intermediate portion of the face ply.

14. The multi-part form of claim 13, wherein the first portion of the face ply comprises a polymer and the second portion of the face ply comprises paper.

15. The multi-part form of claim 13, further comprising an electromagnetic chip for carrying identifying information, embedded in the face ply.

16. The multi-part claim of claim 13, in which the form comprises a continuous web of forms, and wherein the continuous web of forms includes a plurality of tractor feed pin holes.

17. The multi-part claim of claim 13, wherein the first portion of the face ply is die cut to form the detachable wristband, the second portion of the face ply is die cut to form the series of detachable labels, and the intermediate portion of the face ply and the underlying liner ply is die cut to form the removable cards.

18. A multi-part form, comprising:

a single sheet, printable face ply including a first major surface, a second major surface, a pressure sensitive adhesive on at least a portion of one of the first and second major surfaces, a first portion, a second portion and an intermediate portion disposed between the first and second portions, wherein any one of the portions forms a detachable wristband having first and second ends and first and second sides, any one of two remaining portions forms a series of detachable labels, and the remaining portion forms one or more removable cards;

a liner ply coextensive with the face ply and including first and second major surfaces, and a release coating on at least a portion of one of the first and second major surfaces of the liner ply wherein the liner ply and release coating is adhered to the pressure sensitive adhesive and the release coating does not underlie the removable cards; and an electromagnetic chip for carrying identifying information, imbedded in the face ply;

wherein the form comprises a continuous web of forms, including a plurality of tractor feed pin holes.

19. The multi-part form of claim 18, wherein the first, second and intermediate portions of the face ply are separable from one another; wherein the liner ply comprises first, second and intermediate portions, the first portion of the liner ply and release coating adheres to the first portion of the face ply, the second portion of the liner ply and release coating adheres to the second portion of the face ply, and wherein the intermediate portion of the liner ply adheres to the intermediate portion of the face ply; and wherein the first portion of the face ply is die cut to form the detachable wristband, the second portion of the face ply is die cut to form the series of detachable labels, and the intermediate portion of the face ply is die cut to form the removable cards.

20. The multi-part form of claim 18, wherein the first portion of the face ply comprises a polymer and the second portion of the face ply comprises paper.

21. The multi-part form of claim 18, wherein at least a portion of the pressure sensitive adhesive adheres the intermediate portion of the face ply directly to the liner ply.

22. A multi-part form, comprising:

a single sheet, printable face ply including a first major surface, a second major surface, a pressure sensitive adhesive on at least a portion of one of the first and second major surfaces, a first portion forming a detachable wristband having first and second ends and first and second sides, a second portion forming a series of detachable labels, and an intermediate portion forming one or more removable cards disposed between the first and second portions;

a liner ply underlying the face ply and including first and second major surfaces;

a release coating on at least a portion of one of the first and second major surfaces of the liner ply, whereby the liner ply and release coating is adhered to the pressure sensitive adhesive of the face ply, and the release coating does not underlie the removable cards; and wherein the first portion of the face ply is die cut to form the detachable wristband, the second portion of the face ply is die cut to form the series of detachable labels, and the intermediate portion of the face ply is die cut to form the removable cards.

23. The multi-part form of claim 22, wherein the first, second and intermediate portions of the face ply are separable from one another.

24. The multi-part form of claim 23 wherein the liner ply comprises first, second and intermediate portions, the first portion of the liner ply and release coating adheres to the first portion of the face ply, the second portion of the liner ply and release coating adheres to the second portion of the face ply, and wherein the intermediate portion of the liner ply adheres to the intermediate portion of the face ply.

25. The multi-part form of claim 23, wherein the first portion of the face ply comprises a polymer and the second portion of the face ply comprises paper.

26. The multi-part form of claim 22, further comprising an electromagnetic chip for carrying identifying information, embedded in the face ply.

27. A multi-part form, comprising:

a printable face ply including a first major surface, a second major surface, a pressure sensitive adhesive on at least a portion of one of the first and second major surfaces, a first portion forming a detachable wristband having first and second ends and first and second sides, a second portion forming a series of detachable labels, and an intermediate portion forming one or more removable cards disposed between the first and second portions;

a liner ply underlying the face ply and including first and second major surfaces;

a release coating on at least a portion of one of the first and second major surfaces of the liner ply, whereby the liner ply and release coating is adhered to the pressure sensitive adhesive of the face ply, and the release coating does not underlie the removable cards; and wherein the liner ply is coextensive with the face ply, and wherein at least a portion of the pressure sensitive adhesive adheres the intermediate portion of the face ply directly to the liner ply.

28. The multi-part form of claim 27 wherein the first surface of the face ply includes printed indicia thereon.

29. The multi-part form of claim 28, wherein the second surface of the first portion of the face ply includes the pressure sensitive adhesive around the periphery of the wristband and on at least one end of the wristband, and wherein the second surface of the second portion of the face ply includes a pressure sensitive adhesive in an area containing the series of labels.

30. A multi-part form, comprising:

a single sheet, printable face ply including a first major surface, a second major surface, a pressure sensitive adhesive on at least a portion of one of the first and second major surfaces, a first portion, a second portion and an intermediate portion disposed between the first and second portions, wherein any one of the portions forms a detachable wristband having first and second ends and first and second sides, any one of two remaining portions forms a series of detachable labels, and the remaining portion forms one or more removable cards, and wherein second and intermediate portions of the face ply are separable from one another;

a liner ply coextensive with the face ply and including first and second major surfaces, and a release coating on at least a portion of one of the first and second major surfaces of the liner ply whereby the liner ply and release coating is adhered to the pressure sensitive adhesive of the face ply, and the release coating does not underlie the removable cards; and wherein the form comprises a continuous web of forms, and wherein the continuous web of forms includes a plurality of tractor feed pin holes.

31. The multi-part form of claim 30 wherein the first portion of the face ply comprises a polymer and the second portion of the face ply comprises paper.

32. The multi-part form of claim 30, further comprising an electromagnetic chip for carrying identifying information, embedded in the face ply.

33. The multi-part claim of claim 30, wherein the first portion of the face ply is die cut to form the detachable wristband, the second portion of the face ply is die cut to form the series of detachable labels, and the intermediate portion of the face ply and the underlying liner ply is die cut to form the removable cards.

34. A multi-part form, comprising:

a printable face ply including a first major surface, a second major surface, a pressure sensitive adhesive on at least a portion of one of the first and second major surfaces, a first portion, a second portion and an intermediate portion disposed between the first and second portions, wherein any one of the portions forms a detachable wristband having first and second ends and first and second sides, any one of two remaining portions forms a series of detachable labels, and the remaining portion forms one or more removable cards;

a liner ply coextensive with the face ply and including first and second major surfaces, and a release coating on at least a portion of one of the first and second major surfaces of the liner ply wherein the liner ply and release coating is adhered to the pressure sensitive adhesive of the face ply, and the release coating does not underlie the removable cards;

an electromagnetic chip for carrying identifying information, imbedded in the face ply; and wherein at least a portion of the pressure sensitive adhesive adheres the intermediate portion of the face ply directly to the liner ply.

35. The multi-part form of claim 34, wherein the first, second and intermediate portions of the face ply are separable from one another; wherein the liner ply comprises first, second and intermediate portions, the first portion of the liner ply and release coating adheres to the first portion of the face ply, the second portion of the liner ply and release coating adheres to the second portion of the face ply, and wherein the intermediate portion of the liner ply adheres to the intermediate portion of the face ply; and wherein the first portion of the face ply is die cut to form the detachable wristband, the second portion of the face ply is die cut to form the series of detachable labels, and the intermediate portion of the face ply and underlying liner ply is die cut to form the removable cards.

36. The multi-part form of claim 34, wherein the first portion of the face ply comprises a polymer and the second portion of the face ply comprises paper.

37. A multi-part form, comprising:

a single sheet, printable face ply including a first major surface, a second major surface, a pressure sensitive adhesive on at least a portion of one of the first and second major surfaces, a first portion, a second portion, and an intermediate portion at least a part of which is disposed between the first and second portions;

wherein any one of the first, second or intermediate portions forms a detachable wristband having first and second ends and first and second sides, and any one of the two remaining portions forms a series of detachable labels, and the remaining portion forms one or more removable cards;

a liner ply underlining the face ply and including first and second major surfaces; and a release coating on at least a portion of one of the first and second major surfaces of the liner ply, whereby the liner ply and release coating is adhered to the pressure sensitive adhesive of the face ply, and the release coating does not underlie the removable cards.

38. The multi-part form of claim 37, wherein at least one of the first and second portions are separable from the remaining portions of the face ply.

39. The multi-part form of claim 37, wherein the first portion of the face ply is die cut to form the detachable wristband, the second portion of the face ply is die cut to form the series of detachable labels, and the intermediate portion of the face ply and underlying liner ply is die cut to form the removable cards.

40. The multi-part form of claim 37, wherein the first surface of the face ply includes printed indicia thereon.

41. The multi-part form of claim 37, wherein the first portion of the face ply comprises a polymer and the second portion of the face ply comprises paper.

* * * * *